United States Patent [19]

Siemers et al.

[11] Patent Number: 4,537,742

[45] Date of Patent: Aug. 27, 1985

[54] METHOD FOR CONTROLLING DIMENSIONS OF RSPD ARTICLES

[75] Inventors: Paul A. Siemers, Clifton Park; Robert W. Kopp, Ballston Lake; Melvin R. Jackson, Schenectady, all of N.Y.

[73] Assignee: General Electric Company, Schenectady, N.Y.

[21] Appl. No.: 546,234

[22] Filed: Oct. 28, 1983

[51] Int. Cl.[3] ..... B22F 3/00

[52] U.S. Cl. ..... 419/8; 419/5; 419/38; 427/34; 427/423; 148/130; 29/1.11; 29/156.6; 29/527.2

[58] Field of Search ..... 419/8, 51, 5, 38; 29/1.11, 423, 156.6, 527.2; 148/4, 126.1, 130; 427/34, 423, 190, 191, 295, 374.1, 376.4, 376.8, 383.7

[56] References Cited

U.S. PATENT DOCUMENTS

| | | | |
|---|---|---|---|
| 3,917,782 | 11/1975 | Holcombe et al. | 264/81 |
| 4,011,076 | 3/1977 | Hovis, Jr. et al. | 75/211 |
| 4,376,662 | 3/1983 | Brimm | 148/12.3 |
| 4,447,466 | 5/1984 | Jackson et al. | 427/34 |

*Primary Examiner*—Sam Silverberg
*Assistant Examiner*—Ken Jaconetty
*Attorney, Agent, or Firm*—Paul E. Rochford; James C. Davis, Jr.; James Magee, Jr.

[57] ABSTRACT

A method is provided for forming articles from difficult to fabricate materials with precise internal dimensions. The article is first formed to approximate dimensions as a body using the material in powdered form. Plasma spray forming is proposed. The powder formed body is then brought to its final dimensions by consolidating and densifying the body about a densifying mandrel having a coefficient of expansion which is higher and outer dimensions which are slightly smaller than that of the body.

8 Claims, No Drawings

METHOD FOR CONTROLLING DIMENSIONS OF RSPD ARTICLES

The present invention relates to a method of fabricating difficult to fabricate metal parts. More specifically, it relates to a method of achieving good dimensional tolerances in metal parts prepared by plasma deposition.

The plasma deposition technology has been developed and permits materials which are relatively difficult to fabricate, such as refractory alloys and similar materials, to be formed into parts for assembly with other parts or for end use. A critical problem in the formation of parts from difficult to form materials is the achievement of desired end dimensions of the parts. One of the major goals in processing of plasma deposition parts as by rapid solidification plasma deposition (RSPD) or by low pressure plasma deposition (LPPD) is the achievement of the near net shape and near net dimensions for the articles. The achievement of this goal has been particularly difficult because large sized LPPD articles typically have densities of between 96 and 100% and may very well have a variety of densities in a single formed part. The percentage of density is based on the percentage of the theoretical density for the material. To achieve full density, the high temperature heat treatment is used and may be a heat treatment of about 1200°-1250° C., for example for a nickel-base superalloy. During such heat treatment, the shrinkages of the order of 1-4% occur. These shrinkages and heat treatments can often cause distortions of the part and make achievement of close tolerances difficult. The final dimensions of an article are determined at least in part by the amount of shrinkage, and the amount of shrinkage can vary in part because of the porosity of the deposited article and also in part because of the different degree of porosity of different portions of the as formed article.

Under present practice, the near net shape of plasma sprayed parts is achieved by spraying the desired composition of material onto a sacrificial mandrel, which may be a mandrel of copper or steel. The outer dimensions of the sacrificial mandrel are chosen so that they closely match the inner dimensions of the desired part. The outer dimensions of the part are determined by the thickness of the sprayed material deposited and the dimensions of the mandrel. A free standing part is obtained by leaching away the sacrificial mandrel material. After etching to remove the mandrel material, the hollow less-than-fully dense plasma sprayed part may be heat treated as indicated above to densify it to a set of final dimensions and to a final form. Usually, the dimensions of the leachable mandrel are chosen to be slightly larger than the inner dimensions sought for the spray formed part to compensate for densification shrinkages. However, it is found that the achievement of close final tolerances is quite difficult. Further, there is a tendency because of the irregularity of the porosity of the plasma sprayed part to often change its dimensions as the heat treatment is applied so that a heat treated part will not have the same regularity of form as the plasma sprayed part from which it is made. Heat distortion and gravity distortion may also occur. Heat treatment mandrels have been used heretofore but have not been used in connection with densification heat treatment as taught herein.

BRIEF SUMMARY OF THE INVENTION

It is accordingly one object of the present invention to provide a method by which close tolerances may be achieved in fabricating parts by rapid solidification plasma deposition techniques.

Another object is to provide a relatively large part fabricated by rapid solidification plasma deposition and having great regularity of form and very close dimensional tolerances.

Another object is to provide a method which makes possible the formation of articles by rapid solidification plasma deposition and low pressure plasma deposition to close dimensional tolerances.

Another object is to provide articles for use in controlling the dimensional tolerances of articles prepared by plasma deposition.

Other objects and advantages will be in part apparent and in part pointed out in the description that follows.

In one of its broader aspects, the objects of the invention can be carried out by forming a cavitied article of less than full density by plasma deposition and by then heat treating the formed article to induce a densification of the article and to cause a shrinkage of the article and providing a densification mandrel for insertion in and inclusion in the cavity of the article at the time of heat treatment.

As used herein the term cavity, cavitied article or similar terms are meant to designate the portion of an article which has at least one portion of its surfaces confronting at least one other surface portion of the article.

DETAILED DESCRIPTION OF THE INVENTION

In carrying out the process of the present invention, the cavitied part is first formed on a sacrificial or leachable mandrel by a low pressure plasma deposition process. Such deposition can be carried out either in air or in inert gas at reduced pressure. The cavitied part and particularly the cavity of the part is prepared by the rapid solidification plasma deposition technique and is made to be oversized relative to the finished dimensions of the cavity of the final product. Because the plasma deposited product is oversized initially as formed the leachable mandrel on which it is formed must also be oversize relative to the final dimensions of the finished product.

After the deposit by rapid solidification techniques of the material which forms the part, the leachable mandrel is removed by dissolution in an appropriate chemical, such as an acid, as for example, nitric acid to leave a cavity which was at least partially occupied by the mandrel.

At this point the deposit of material that forms the article has a degree of porosity and in order to give the article full density and the benefit of the properties which are achieved through full density, the article is subjected to a heat treatment at elevated temperature for an appropriate time to densify the article to its theoretical density or close to the theoretical density. The deposit of a layer of material to form an article on a mandrel by plasma deposition and the heat treatment of an article to densify the deposited layer has produced articles which may have a range of final dimensions, depending on the degree of porosity of each of the deposited layers and the extent of heat treatment which is applied. Further, the articles, and particularly larger dimensions articles are found to be distorted relative to the mandrel on which the deposited layer is made by the steps of removal of the mandrel by chemical means followed by the heat treatment of the porous deposit to densify the deposit. In part the distortion is caused by the relief of residual stresses which are built into the deposit as it is formed and by the influence of gravitational forces. Also, the different degrees of density and porosity and the different degrees of densification which accompany the heat treatment can cause some warping and distortion of the form of a product relative to the mandrel on which the deposit is made.

In accordance with the present invention, a densification mandrel is employed to permit the attainment of a finished dimension of a plasma deposited article to final dimensions and final form with high precision.

The densification mandrel to be used in connection with the present invention must have certain properties in order for it to function satisfactorily in providing a critical support for the cavitied portion of a plasma deposited part as it is densified. In the first place, the densification mandrel must have a thermal expansion which is greater than that of the plasma sprayed body. Accordingly, the thermal coefficient of expansion must be higher than that of the deposited plasma sprayed body.

Secondly, the densification mandrel must be able to withstand the temperature of densification of the plasma sprayed body and must not itself be warped or distorted by the densification sintering temperature.

A coefficient of expansion greater than that of the plasma sprayed body is necessary to insure that the mandrel will shrink away from the spray formed body when the densification of the body is complete and the pair are cooled down from the elevated sintering and consolidation temperature.

Next, it has been found that the densification mandrel must be prepared to have outer dimensions which cause an interference and accordingly a contact with the inside of the plasma spray formed body during the densification heating. In this connection, the degree of shrinkage of the spray formed body, if it is not constrained, can be estimated from its as-sprayed density or can be determined experimentally from a few simple tests.

In practicing the present invention, the densification mandrel is made to have outer dimensions which are slightly smaller than the desired inner dimensions of the spray formed body. The densification mandrel is made slightly smaller than the desired final inner dimensions of the body because there is a greater thermal expansion of the solidification mandrel and accordingly, a greater contraction of this mandrel following the densification heating than occurs for the spray formed body. The thermal expansion and contraction of the densification mandrel and also of the spray formed body must be distinguished from the shrinkage of the spray formed body.

The body goes from its somewhat porous as-deposited condition to the fully dense, or near fully dense condition, based on the high temperature of heat treatment. In other words, the difference in dimensions of the mandrel and the solidified spray-formed body are selected to reflect the difference in the thermal expansion and contraction of these two bodies relative to one another as the body and mandrel are cooled from the elevated temperature of heat treatment. As noted above, the densification mandrel is made of a material which is selected to have a higher thermal expansion and contraction than that of the spray formed body where the expansion and contraction due to the heating and cooling are based on the expansion and contraction alone and are not dependent on the densification and shrinking of the spray formed body at the heat treatment temperature.

For purposes of convenience and ease of fabrication, a layer of boron nitride may be employed as a parting layer between the densification mandrel and the spray formed body prior to the densification heating. The layer may be applied as a light slurry over the mandrel to leave a deposit of very fine particles on the densification mandrel surface. Boron nitride is a useful and beneficial parting layer for the densification of superalloys, for example, and is generally unreactive with the superalloys at their sintering temperature. The boron nitride prevents interdiffusion of the densification mandrel with the inner surface of the spray formed body and also serves as a lubricant for removal of the mandrel.

The invention described above is particularly useful for achievement of close tolerances for less than fully dense cylindrical bodies, such as aircraft electrical generator retaining rings, plasma sprayed gun barrels, aircraft engine combustion rings, and for numerous other cylindrical or non-cylindrical hollow or cavitated bodies of high performance materials, such as the superalloys, where close dimensional tolerances on the inside diameter of the structure is sought and desired. Split densification mandrels can be made when there is a re-entrant angle to the overall geometry.

Among the materials which may be employed in fabricating parts according to the present method are the refractory metals and alloys of these metals, the superalloys of nickel-base, cobalt-base, iron-base and chromium-base and other similar high temperature metal compositions. In addition, the compounds of some of these metals, such as the borides, nitrides, oxides or carbides of such metals may be included in the spray formed body as constituents or additives.

As a first step in the performance of the process, the material to be spray formed must be provided in a finely divided form for introduction into the plasma of a plasma spray gun-type apparatus. A commercially available plasma spray system which may be employed in the practice of the present invention is one manufactured by Electro-Plasma, Inc., Santa Anna, Calif. It incorporates an 80-kw plasma gun and normally operates at a pressure of 30–60 torr.

What is claimed is:

1. A method of forming an article to close internal dimensions from a difficult to fabricate material which comprises providing the material in a finely divided form, low pressure plasma spraying the material to form a body having a density less than 100% of its theoretical density, and having an internal cavity, providing a densification mandrel having dimensions slightly smaller than the final dimensions to be imparted to said cavity and having a thermal coefficient of expansion greater than that of said body, introducing said densification mandrel into said cavity and heat treating said body and densification mandrel to densify said body and to shrink said body into contact with said mandrel and to impart to said body a set of desired internal dimensions.

2. The method of claim 1 wherein the plasma spraying is at reduced pressure.

3. The method of claim 1 wherein the finely divided material is at least partially an alloy of nickel, cobalt, iron or chromium.

4. The method of claim 1 wherein the finely divided material is at least partially a refractory metal.

5. The method of claim 1 wherein the plasma sprayed body has a density of about 96 to 99% of theoretical.

6. The method of claim 1 wherein the cavity is the bore of a rifle.

7. The method of claim 1 wherein the body is an aircraft engine combustor ring.

8. The method of claim 1 wherein the body is an aircraft electrical generator retaining ring.

* * * * *